US008264444B2

(12) United States Patent
Yoshiga

(10) Patent No.: US 8,264,444 B2
(45) Date of Patent: Sep. 11, 2012

(54) LOW-FLICKERING DISPLAY DEVICE

(75) Inventor: Masahiro Yoshiga, Hyogo (JP)

(73) Assignee: Chimei Innolux Corporation, Chu-Nan (TW)

( * ) Notice: Subject to any disclaimer, the term of this patent is extended or adjusted under 35 U.S.C. 154(b) by 614 days.

(21) Appl. No.: 12/404,141

(22) Filed: Mar. 13, 2009

(65) Prior Publication Data

US 2009/0237387 A1 Sep. 24, 2009

(30) Foreign Application Priority Data

Mar. 13, 2008 (JP) ..... 2008-064406

(51) Int. Cl.
*G09G 3/36* (2006.01)
*G09G 5/00* (2006.01)

(52) U.S. Cl. ..... 345/100; 345/204; 345/98

(58) Field of Classification Search ..... None
See application file for complete search history.

(56) References Cited

U.S. PATENT DOCUMENTS

| | | | | |
|---|---|---|---|---|
| 5,896,117 | A | 4/1999 | Moon | |
| 7,304,622 | B2 * | 12/2007 | Kobayashi et al. | 345/87 |
| 2006/0050563 | A1 | 3/2006 | Lee | |

FOREIGN PATENT DOCUMENTS

| | | |
|---|---|---|
| JP | 64-068793 | 3/1989 |
| JP | 2-136824 | 5/1990 |
| JP | 2-196218 | 8/1990 |
| JP | 5-346571 | 12/1993 |
| JP | 2001-166741 | 6/2001 |
| JP | 2003-058132 | 2/2003 |
| JP | 2007-188079 | 7/2007 |

* cited by examiner

*Primary Examiner* — Andrew L Sniezek
(74) *Attorney, Agent, or Firm* — Liu & Liu

(57) ABSTRACT

A display device includes a pixel electrode; a transistor for supplying a driving voltage to the electrode pixel; and a gate-line driver circuit for providing a gate voltage to the transistor and inversely driving a driving voltage supplied to the electrode pixel via the transistor. The gate voltage has different voltage levels in a first driving state that the gate-line driver circuit drives the transistor with a level of the driving voltage and in a second driving state that the gate-line driver circuit drives the transistor with another level of the driving voltage.

4 Claims, 6 Drawing Sheets

LOW-FLICKERING DISPLAY DEVICE

FIELD OF THE INVENTION

The present invention relates to a display device, and more particularly to a display device in which the driving voltage supplied to the pixel electrode is alternately inverted. The present invention also relates to an electronic apparatus and a system including the display device.

BACKGROUND OF THE INVENTION

Due to the features of miniaturization and low power consumption, a liquid crystal display (LCD) is an ideal display device for a computer, a mobile phone, etc.

In an active matrix LCD which uses thin film transistors (TFTs) to provide voltages for pixel electrodes, TFTs are disposed between pixel electrodes and corresponding data lines. By switching TFTs via gates lines, voltages supplied through the data lines can be selectively provided to the pixel electrodes. An example is described in Japanese Laid-Open Patent Publication No. 2007-188079.

For elongating the life spin of an LCD, the voltage applied between the pixel electrodes and a common electrode should be contemplated so as to avoid the situation that liquid crystal molecules always rotate in the same direction. For example, the object can be achieved by alternately inverting the voltages supplied to the liquid crystal molecules frame by frame, and/or supplying opposite voltages to the liquid crystal molecules of adjacent lines in the same frame.

FIG. 6 illustrates a gate-line driving method according to prior art, wherein the left (A) portion shows the states of gate voltage Vg, drain voltage Vd, source voltage Vs of a TFT for controlling the voltage applied to a pixel under a first driving state; and the right (B) portion shows the states of gate voltage Vg, drain voltage Vd, source voltage Vs of the TFT for controlling the voltage applied to the pixel under a second driving state.

As shown in FIG. 6, the gate voltage Vg is constant either in the first driving state or the second driving state. Therefore, in the first driving state as shown in the (A) portion, the gate voltage Vg equals to a base voltage Vg1 when the TFT is turned off, and the difference between the base voltage Vg1 of the gate voltage Vg and the drain voltage Vd is 2.3V; while in the second driving state as shown in the (B) portion, the gate voltage Vg equals to a base voltage Vg1 when the TFT is turned off, and the difference between the base voltage Vg1 of the gate voltage Vg and the source voltage Vs is enlarged to 7.5V. Accordingly, the TFT has different turn-off currents Ioff in the first driving state and the second driving state. The difference in turn-off currents Ioff would result in deteriorated image quality, e.g. flickering frames.

SUMMARY OF THE INVENTION

Therefore, an object of the present invention is to provide a display device, an electronic device and a system in which the flickering effect is ameliorated.

The present invention relates to a display device, which includes a pixel electrode; a transistor for supplying a driving voltage to the electrode pixel; and a gate-line driver circuit for providing a gate voltage to the transistor and inversely driving a driving voltage supplied to the electrode pixel via the transistor. The gate voltage has different voltage levels in a first driving state that the gate-line driver circuit drives the transistor with a level of the driving voltage and in a second driving state that the gate-line driver circuit drives the transistor with another level of the driving voltage.

In an embodiment, the difference between the base voltage levels of the gate voltage in the first driving state and the second driving state is controlled to minimize a difference between turn-off currents of the transistor in the first driving state and the second driving state.

In an embodiment, the gate voltage has different base voltage levels in a first driving state that the gate-line driver circuit drives the transistor with the level of the driving voltage and in a second driving state that the gate-line driver circuit drives the transistor with the another level of the driving voltage.

In an embodiment, the gate-line driver circuit includes: a gate-voltage generating circuit for generating a gate voltage for driving the transistor in response to the driving voltage; a level shift circuit for converting a level of the gate voltage generated by the gate-voltage generating circuit into another level of the gate voltage in response to the another level of the driving voltage; and a switching circuit outputting the level of the gate voltage in the first driving state, and outputting the another level of the gate voltage level-shifted by the level shift circuit in the second driving state.

The present invention further relates to an electronic apparatus comprising the display device as described above.

The present invention further relates to a system comprising the electronic apparatus as described above.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

Figure 1:
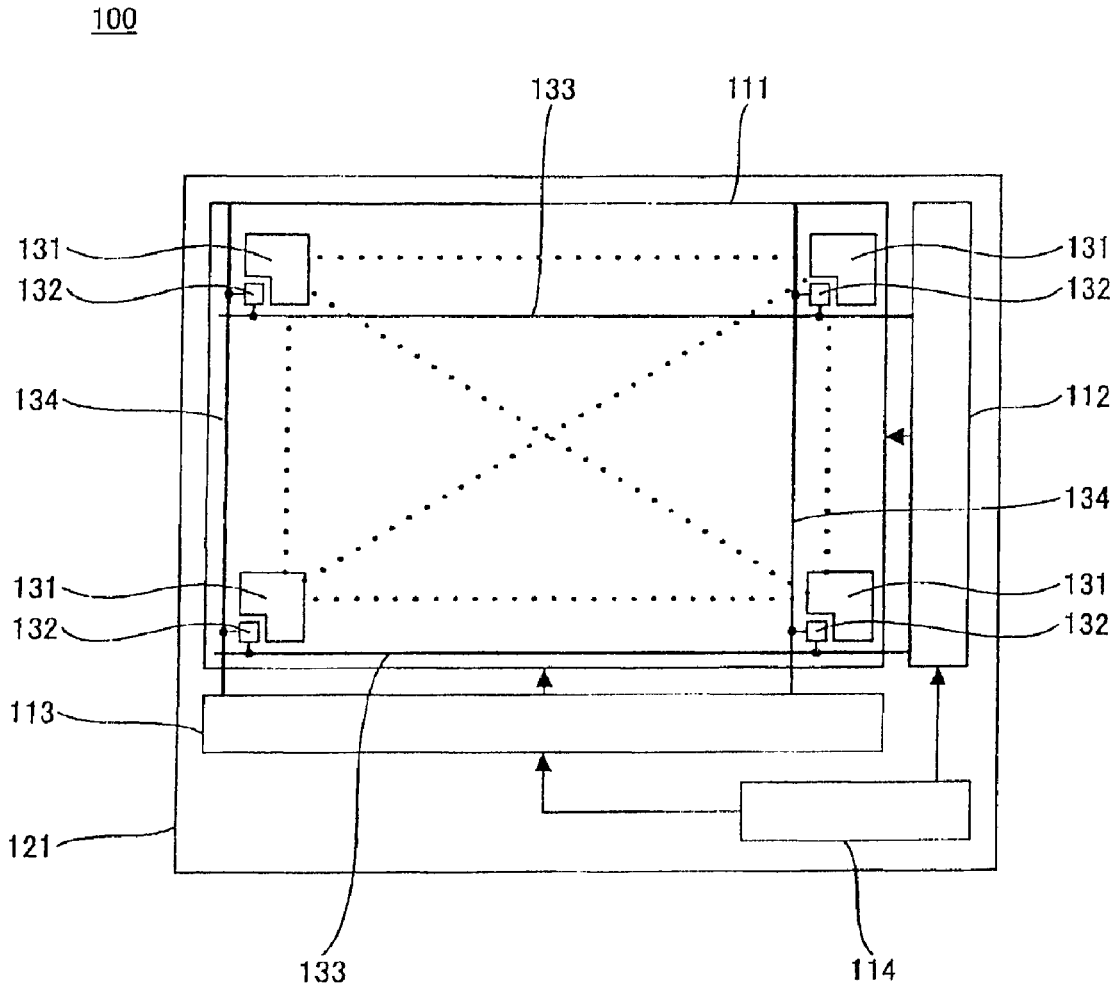
FIG. 1 is a schematic diagram illustrating a display device according to an embodiment of the present invention.

FIG. 1 schematically illustrates a display device according to an embodiment of the present invention. The display device 100 is an active matrix LCD including a display portion 111, a gate-line driver circuit 112, a data-line driver circuit 113 and an interface circuit 114.

Figure 2:
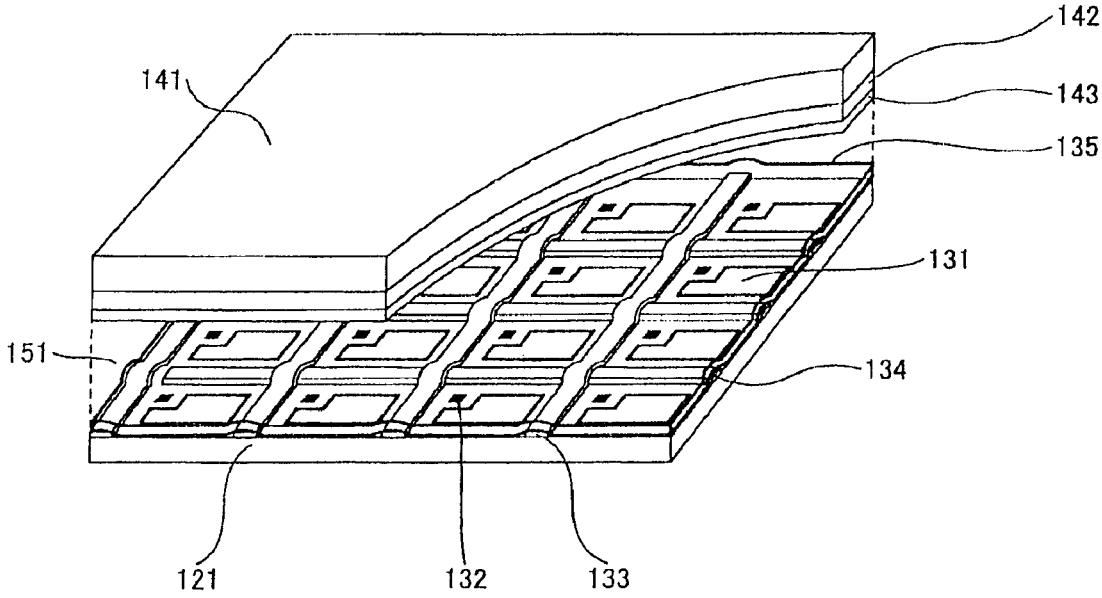
FIG. 2 is a schematic diagram illustrating main components of the display portion 111 of FIG. 1.

FIG. 2 schematically illustrates the display portion 111. In the display portion 111, matrices of the pixel electrodes 131, thin film transistors (TFTs) 132, gate lines 133 and data lines 134 are formed on a lower glass substrate 121 directly or for example through a protective film. In addition, an aligning film 135 overlies the pixel electrodes 131, TFTs 132, gate lines 133 and data lines 134, and faces an upper glass substrate 141 through a spacer layer (not shown). In addition, a common electrode 142 and an aligning film 143 are formed all over the surface of the upper glass substrate 141 facing the lower glass substrate 121, and liquid crystal molecules 151 are sealed between the lower glass substrate 121 and the upper glass substrate 141.

The gate-line driver circuit 112 is connected to gates of the TFTs 132 via the gate lines 133, and the TFTs 132 are switched by the gate voltages supplied via the gate lines 133 from the gate-line driver circuit 112. When the TFTs 132 are turned on, voltages are supplied to the pixel electrodes 131 via the data lines 134. By way of applying driving voltages to the pixel electrodes 131, the orientations of liquid crystal molecules 151 will change with the potential differences between the pixel electrodes 131 and the common electrode 142 so as to change optical properties of the display for displaying pixels. The driving voltages applied to the pixel electrodes 131 are alternately inverted by the gate-line driver circuit 112 through the TFTs 132, for example frame by frame.

Figure 3:
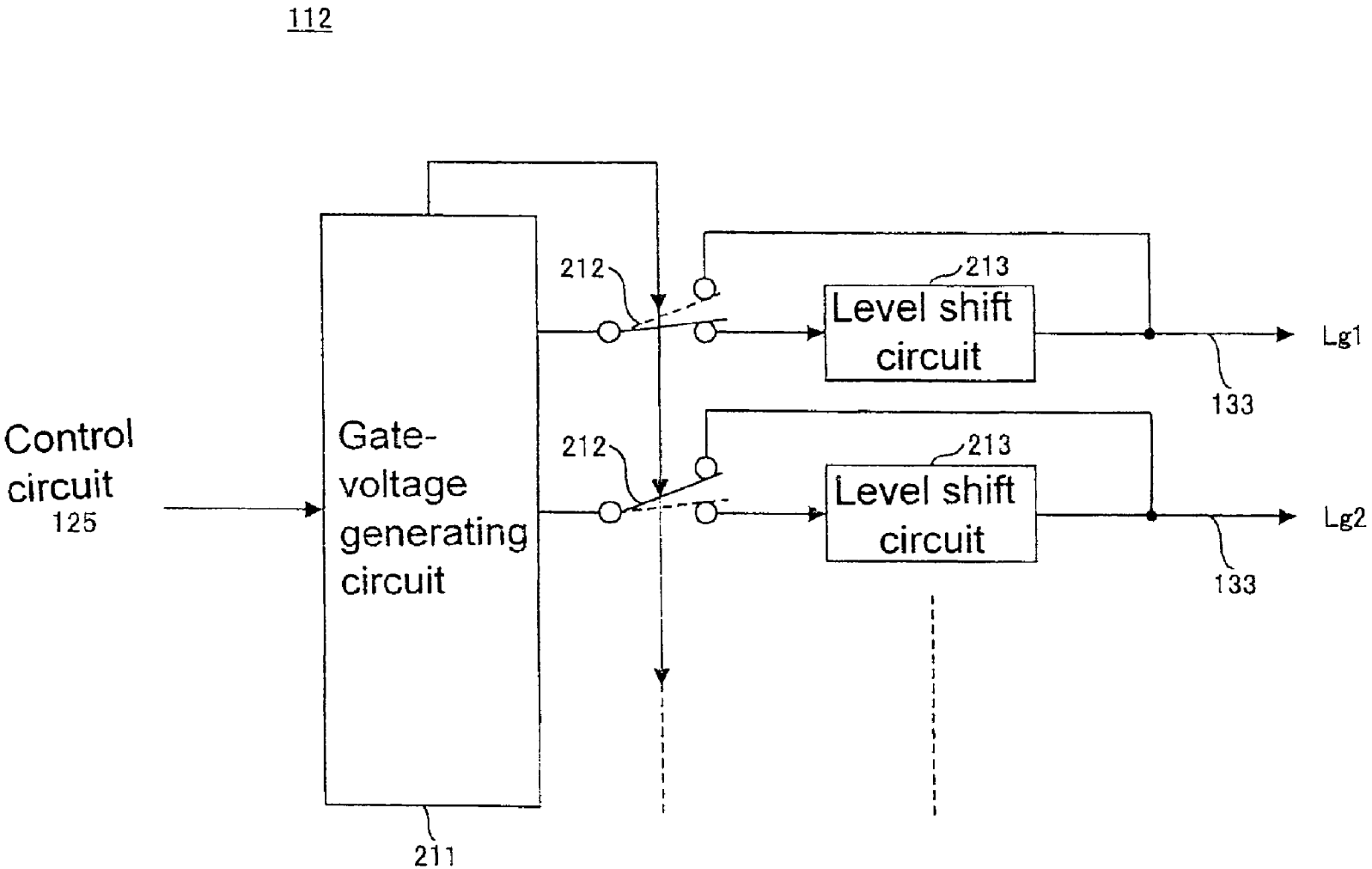
FIG. 3 is functional block diagram illustrating the gate-line driver circuit 112 of FIG. 1.

FIG. 3 schematically illustrates the gate-line driver circuit 112. The gate-line driver circuit 112 includes a gate-voltage generating circuit 211, switching circuits 212 and level shift circuits 213. The gate-voltage generating circuit 211, in response to a timing signal provided by the interface circuit 114, supplies a level of the gate voltage to the switching circuit 212 sequentially via respective gate lines 133.

Each of the switching circuits 212 performs a switching operation according to a switching-control signal from the gate-line driver circuit 112. For example, when the gate-line driver circuit 112 provides an output to a predetermined Lg1, a corresponding switching circuit 212 performs the switching operation to supply another level of the gate voltage obtained by level-shifting the output of the gate-line driver circuit 112 by a corresponding level shift circuit 213 to next predetermined line Lg2.

Meanwhile, assume a gate voltage Vg is supplied by the gate-voltage generating circuit 211 and then shifted to a level Vg' by the level shift circuit 213. Then the base voltage Vg1 of the gate voltage Vg supplied by the gate-voltage generating circuit 211 is, for example, −7.5V, while the base voltage Vg1' of the gate voltage Vg' outputted by the level shift circuit 213 is, for example, −5.1 V, which is up-shifted with 2.4V.

Figure 4:
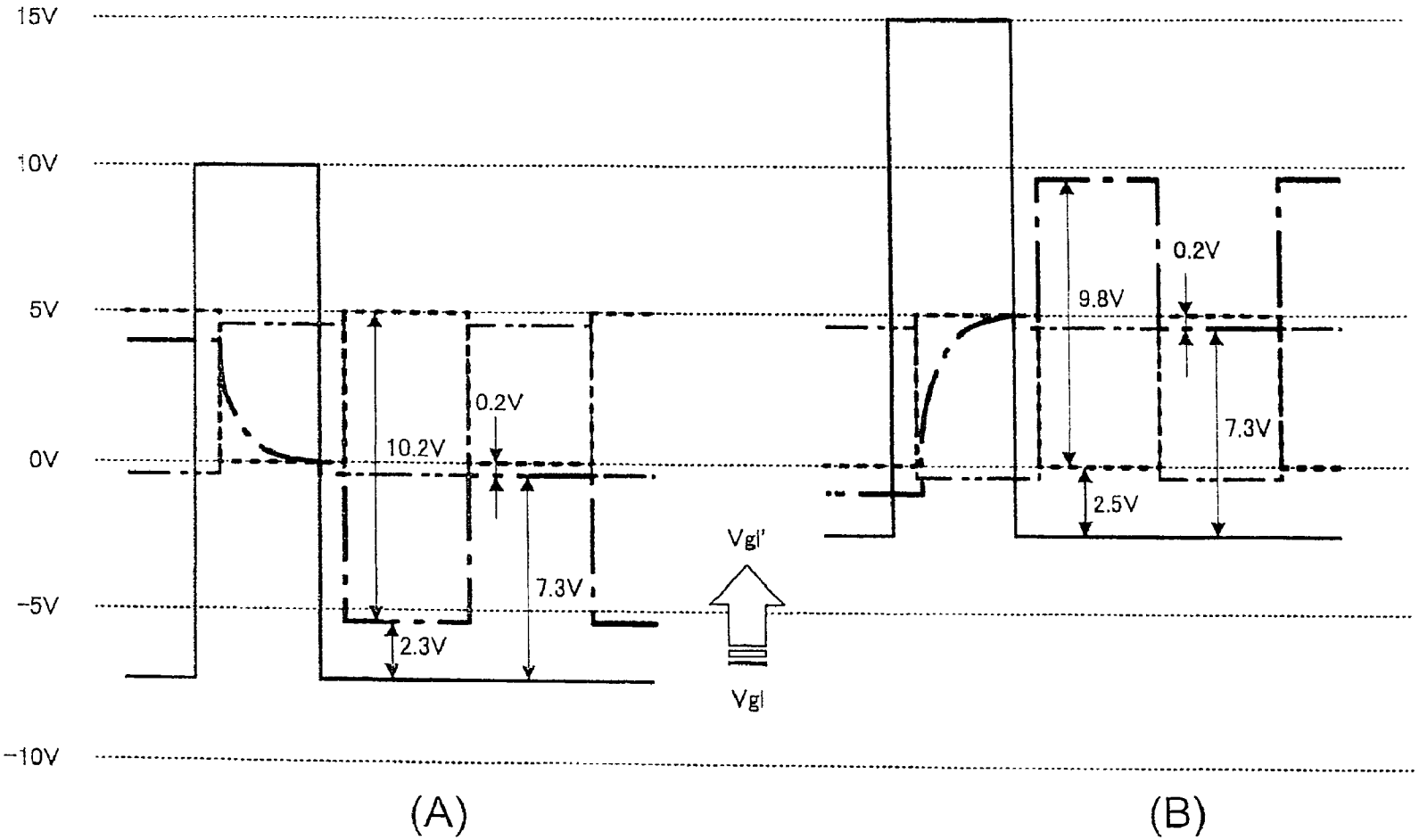
FIG. 4 is a schematic waveform diagram illustrating the states of the TFT 132 of FIG. 1 in a first driving state and a second driving state.

FIG. 4 illustrates an operational property of the TFT 132, wherein the left (A) portion shows the states of the TFT in a first driving state; and the right (B) portion shows the states of the TFT in a second driving state. In FIG. 4, the solid lines indicate the gate voltages Vg; the dash lines indicate the source voltage Vs; the dash-dot lines indicate the drain voltage Vd; and the dash-dot-dot lines indicate the common voltage Vcom applied to the common electrode 142.

In the gate-line driver circuit 112, the driving gate voltage Vg of the TFT 132 in the first driving state is about +10~−7.5V, as shown in the (A) portion, while the driving gate voltage Vg' of the TFT 132 in the second driving state is about +15~−2.5V, as shown in the (B) portion. Accordingly, while driving the TFT 132, there is a voltage difference 2.3V between the base voltage Vg1 of the gate voltage Vg and the base voltage Vd1 of the drain voltage Vd in the first driving state corresponding to the (A) portion. On the other hand, in the second driving state corresponding to the (B) portion, there is a voltage difference 2.5V between the base voltage Vg1' of the gate voltage Vg' and the base voltage Vs1 of the source voltage Vs. The difference between the voltage difference in the first driving state and that in the second driving state is as low as about 0.2V. Therefore, the turn-off current can be reduced in the second driving state. Furthermore, the difference between the turn-off currents in the first and second driving states can also be reduced so as to ameliorate flickering.

Figure 5:
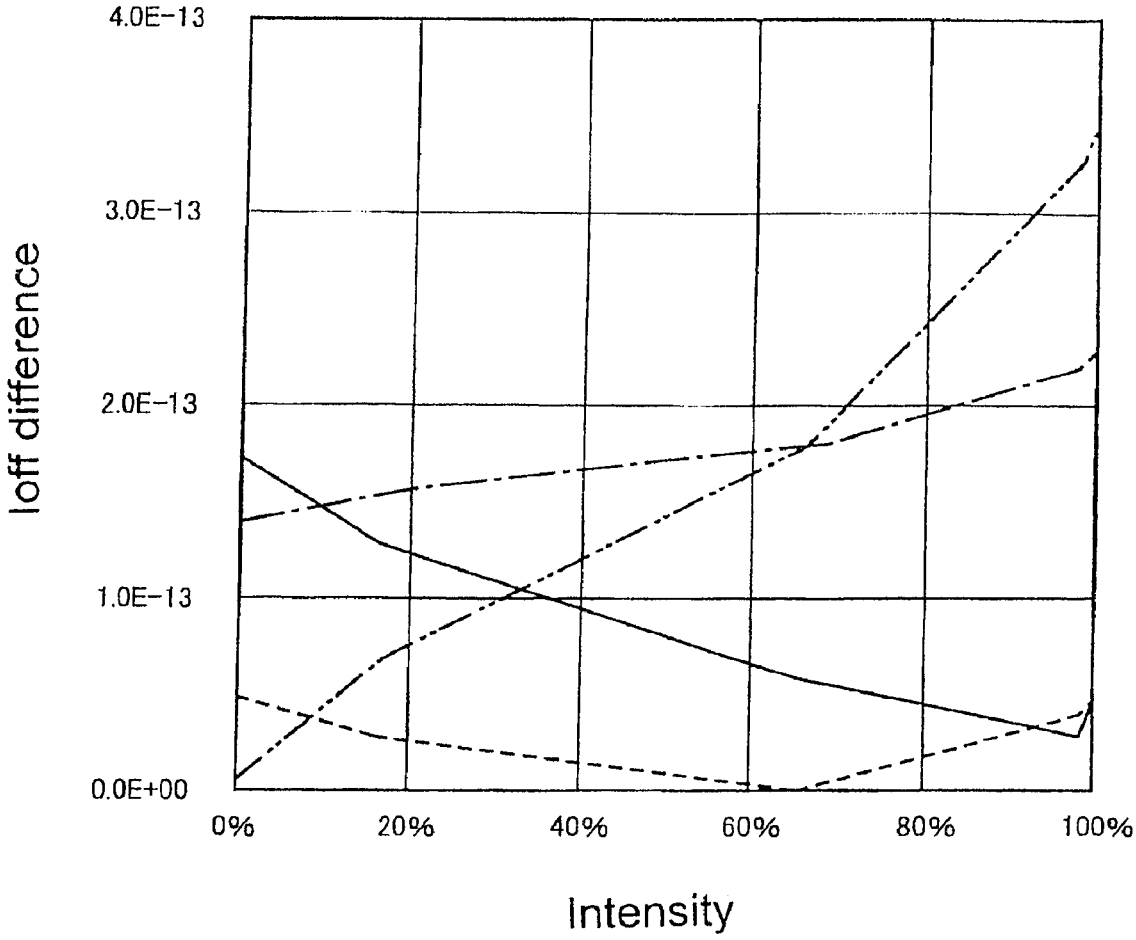
FIG. 5 is a plot showing turn-off current features of the TFT 132 of FIG. 1 relative to display voltage levels.
Figure 6:
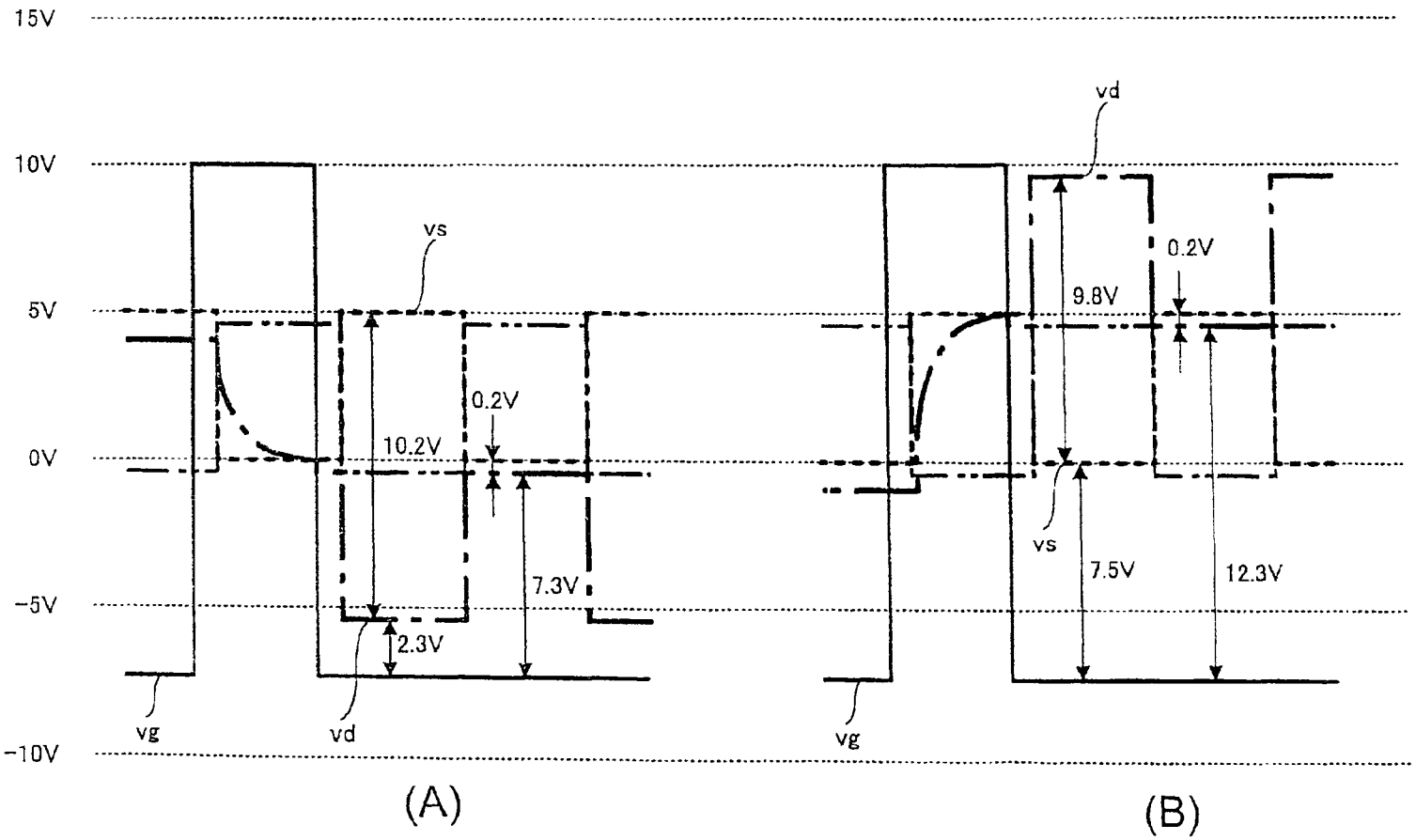
FIG. 6 PRIOR ART
FIG. 6 is a schematic waveform diagram illustrating the states of a TFT in a first driving state and a second driving state according to prior art.

FIG. 5 illustrates turn-off current features of the TFT 132 relative to display voltage levels, in which the solid line and the dash line respectively indicate the features of the difference ΔIoff between the turn-off currents Ioff in the first and second driving states during the driving operation of the gate-line driver circuit 112; and the dash-dot line and the dash-dot-dot line respective indicate the features of the difference ΔIoff between the turn-off currents Ioff in the first and second driving states on a condition that the base voltages Vg1 and Vg1' of the gate voltage are fixed at −7.5V.

It can be seen from FIG. 5 that using the gate-line driver circuit 112 according to the present invention to drive the gate lines 133 results in the reduction of the difference ΔIoff between the turn-off currents Ioff in the first and second driving states. Accordingly, the difference in leak current occurring when turning off the TFT in the first and second driving states, respectively, can be reduced as well so as to lower flickering.

The display device according to the present invention can be used with a variety of electronic devices such as a computer, a television, etc. Alternatively, an electronic device equipped with the present display device may be applied to a data-processing system and so on.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A display device, comprising:

a pixel electrode;

a transistor supplying a driving voltage to the electrode pixel; and a gate-line driver circuit providing a gate voltage to the transistor and alternately inverting the driving voltage supplied to the pixel electrode via the transistor between a first driving state and a second driving state, wherein the driving voltage in the second driving state is inverted with respect to the driving voltage in the first driving state, wherein the gate-line driver circuit drives the transistor with a first level of the driving voltage in the first driving state and the gate-line driver circuit drives the transistor with a second level of the driving voltage in the second driving state, and wherein the gate-line driver circuit includes:

a gate-voltage generating circuit generating the gate voltage to drive the transistor in response to the driving voltage;

a level shift circuit converting a first level of the gate voltage generated by the gate-voltage generating circuit into a second level of the gate voltage in response to the second level of the driving voltage; and a switching circuit outputting the first level of the gate voltage in the first driving state, and outputting the second level of the gate voltage level-shifted by the level shift circuit in the second driving state;

wherein the gate voltage has different base voltage levels between the first driving state and the second driving state.

2. The display device according to claim 1 wherein the difference between the base voltage levels of the gate voltage in the first driving state and the second driving state is controlled to minimize a difference between turn-off currents of the transistor in the first driving state and the second driving state.

3. A display device, comprising:

a pixel electrode;

a transistor supplying a driving voltage to the electrode pixel; and a gate-line driver circuit providing a gate voltage to the transistor, wherein the gate voltage has a base voltage level that is different between a first driving state and a second driving state, and the gate-line driver circuit alternately inverting the driving voltage supplied to the pixel electrode via the transistor between the first driving state and the second driving state, wherein the driving voltage in the second driving state is inverted with respect to the driving voltage in the first driving state, wherein the gate-line driver circuit drives the transistor with a first level of the driving voltage in the first driving state and the gate-line driver circuit drives the transistor with a second level of the driving voltage in the second driving state, and wherein the gate-line driver circuit includes:

a gate-voltage generating circuit generating the gate voltage;

a level shift circuit converting a first level of the gate voltage generated by the gate-voltage generating circuit into a second level of the gate voltage in response to the second level of the driving voltage; and a switching circuit outputting the first level of the gate voltage in the first driving state, and outputting the second level of the gate voltage level-shifted by the level shift circuit in the second driving state.

4. The display device according to claim 3 wherein the difference between the base voltage levels of the gate voltage in the first driving state and the second driving state is controlled to minimize a difference between turn-off currents of the transistor in the first driving state and the second driving state.

* * * * *